US005601283A

United States Patent [19]

Pinckney

[11] Patent Number: 5,601,283

[45] Date of Patent: Feb. 11, 1997

[54] CROSS ROLL REGISTRATION DESKEW BASED ON PAPER WEIGHT

[75] Inventor: Timothy S. Pinckney, Fairport, N.Y.

[73] Assignee: Xerox Corporation, Stamford, Conn.

[21] Appl. No.: 586,474

[22] Filed: Jan. 11, 1996

[51] Int. Cl.[6] ..... B65H 7/02

[52] U.S. Cl. ..... 271/228; 271/252; 271/272

[58] Field of Search ..... 271/227, 228, 271/248, 250, 251, 252, 253, 254, 272

[56] References Cited

U.S. PATENT DOCUMENTS

| | | | |
|---|---|---|---|
| 4,919,318 | 4/1990 | Wong | 271/250 |
| 5,127,643 | 7/1992 | DeSanctis et al. | 271/9 |
| 5,219,159 | 6/1993 | Malachowski et al. | 271/252 |
| 5,251,893 | 10/1993 | Schoenbenz | 271/252 |
| 5,253,862 | 10/1993 | Acquaviva et al. | 271/251 |

FOREIGN PATENT DOCUMENTS

| | | | |
|---|---|---|---|
| 0075553 | 3/1990 | Japan | 271/227 |
| 5-330702 | 12/1993 | Japan | 271/251 |
| 6-001498 | 1/1994 | Japan | 271/227 |

*Primary Examiner*—H. Grant Skaggs
*Attorney, Agent, or Firm*—William A. Henry, II

[57] ABSTRACT

A sheet handler for deskewing and registering sheets en route to a processing station in an image processing apparatus includes cross rolls that drive each copy sheet against a registration edge for deskewing purposes. The angle of a driven one of the cross rolls with respect to the registration edge is adjusted, as well as, its speed varied based on the output of a sheet weight detector to a controller that controls pivotal movement of the driven cross roll.

14 Claims, 1 Drawing Sheet

CROSS ROLL REGISTRATION DESKEW BASED ON PAPER WEIGHT

BACKGROUND OF THE INVENTION

This invention relates to an electrophotographic printing machine, and more particularly to a sheet handler having a swiveling cross roll assembly that registers and deskew sheet material.

Sheet handlers with registration systems are well known. Generally, the sheet handler have a defined path through which the sheet-like material is transported from one station of an imaging apparatus to another. Registration of documents in such paths is commonly accomplished by driving the sheet-like material to a registered condition against a registration edge. Common means for applying the driving force to move the sheet-like material to the registration edge include cross-rollers, a pinch roller, an angle ball on a belt or any other similar well known device. This particular invention is concerned with cross-rollers.

Sheet handlers are often employed to automatically transport sheet-like material, e.g., documents, copy sheet and the like, to and from processing stations in image processing devices, such as image input terminals and printers. The sheet handlers, for effectiveness, register the sheet-like material during transport thereof. Registration of the sheet-like material in such image processing devices permits accurate, repeatable and, thus, acceptable functioning of such devices.

Sheet handlers used with an image input terminal transport image bearing sheet-like material, commonly called a document, to an imaging station for recording the image into or onto another medium, e.g., electronic medium, an imaging surface, such as a photoconductive surface and the like. Document handlers used with these terminals have document registration means so that documents are presented for imaging in a registered form. Failure to register the documents in such systems result in a skewed image being recorded.

Often in printers, sheet handlers are used to transport sheet-like material, such as, cut sheets having an image recorded thereon. Again, registration means are provided in many printers, as failure to present a registered sheet to the imprinting station often results in a skewed image formed on the sheet and even missing portions of the image. Also, in printers, others processing stations, such as, stapling stations, binding stations, etc. are often provided and registration means in the sheet handler are provided to deliver registered sheet-like material thereto.

Registration of sheet-like material, in some instances, is accomplished through the use of cross-rollers. In these devices, the rollers generally contact each other in the sheet path at a nip through which the sheet-like material passes. The rollers are arranged to have a normal force between them and, thus, provide a lateral force on the sheet-like material passing through the nip. The cross-rollers are skewed to the direction of travel of the sheet-like material passing between the rollers laterally against a registration edge and normally along the path that is at some skew angle bisecting the path direction and the lateral direction.

Optimally, the lateral force on the sheet-like material provided by the cross-rollers is sufficient to move the sheet-like material to and against the registration edge but is insufficient to buckle the sheet-like material upon engagement. That is, the edge of the sheet-like material upon engagement with the registration edge slides along the registration edge, as it slips in the rollers in the lateral direction. In present systems, the normal force, coefficient of friction and skew orientation of the rollers determine the lateral force applied to direct the sheet-like materials passing therebetween. The beam strength of the sheet-like material in combination with the force applied to direct the sheet-like material determines whether the material moves to engage the registration edge and whether the material buckles upon engagement with the registration edge. Thus, there exists a need to provide a relatively simple, inexpensive and reliable means for remotely adjusting the cross-roll registration system to met requirements for all weights of sheet-like material.

Accordingly, it has been deemed desirable to overcome skew and registration problems encountered with different weights of paper, particularly those associated with a cross-roll registration systems.

PRIOR ART

A sheet handler for successively transporting sheet-like material units to and from processing stations in image processing devices, such as, printers, copiers, and scanners is shown in U.S. Pat. No. 5,253,862 that includes an idler and driven cross-roller set that is normal force adjustable. The rollers are preloaded so that a normal force exists between the rollers at the nip. The nip is positioned in a path for receiving the sheet-like material units and to urge the units along the path and into alignment along a registration edge. Apparatus is included to adjust the normal force on the sheet-like material passing through the nip.

SUMMARY OF THE INVENTION

The present invention contemplates a new and improved method and apparatus for reducing skewing problems associated with transporting sheet-like material to a processing station on an imaging device in a simple and economical manner.

According to the present invention, a printing machine that transfers an image at a transfer work station or zone incorporates a cross-roll deskewing apparatus that adjusts the angle of the driving one of the cross rolls, as well as, the speed of the driving roll based on the weight of the sheet-like material to thereby minimizing sheet-like material skewing problems.

According to a more limited aspect of the invention, the cross-roll deskewing apparatus employs a swiveling cross roll assembly that is stepper motor adjustable in response to a signal from a basis weight detector.

Still other advantages and benefits are offered by the subject invention.

BRIEF DESCRIPTION OF THE DRAWINGS

For a better understanding of the invention, as well as other objects and further features thereof, reference is made to the following drawings.

DETAILED DESCRIPTION OF THE INVENTION

Figure 1:
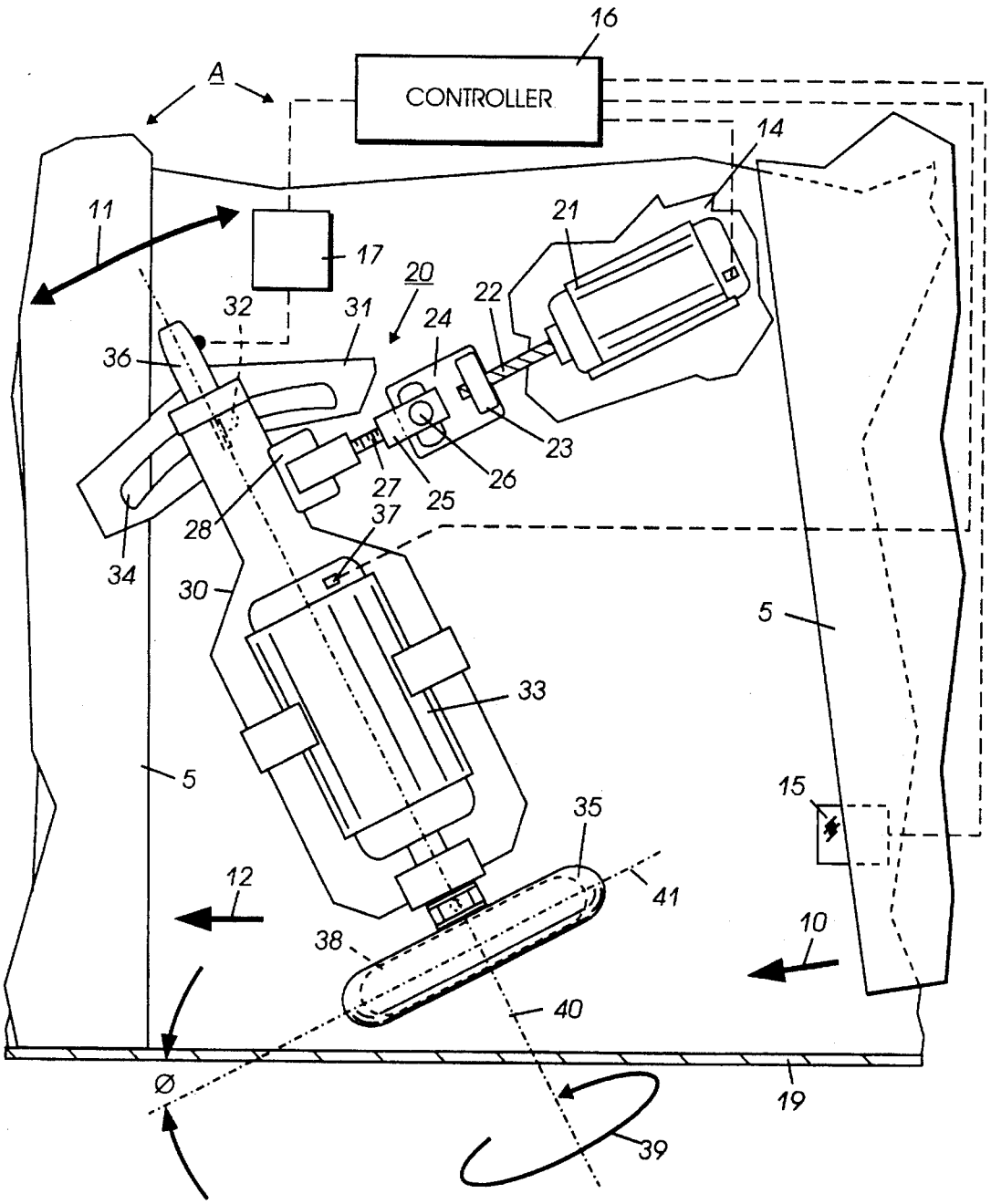
FIG. 1 is a schematic plan view of the cross roll registration device of the present invention used in a printing apparatus

Referring now to the drawings wherein the showings are for purposes of illustrating the preferred embodiment and method of invention only and not for purposes of limiting same, the Figure shows a controller that is one portion of a xerographic copy reproduction machine A. Details of the overall xerographic process and printing machines of this general type are well known so that discussion of those overall features herein is deemed unnecessary to a full and complete understanding of the invention.

More particularly, the copy machine A of FIG. 1 typically includes an endless xerographic photoreceptor belt that travels around a closed loop path that is generally right angle triangular. The belt travels in a counterclockwise direction about a series of three rollers and various stations or zones are represented along this closed loop path. The processing stations employed in the copy machine are well known and will only be discussed briefly herein.

The different stations perform the various steps in the xerographic process. For example, along a generally horizontal path between two of the rollers, the belt is corona charged. As the belt proceeds along the horizontal path, image exposing occurs at a work station. Due to particular properties of the belt, the image is electrostatically formed on the surface of the belt. The belt then proceeds around one of the rollers and extends in a downward direction. Image developing occurs along this portion of the path where toner is applied to the belt electrostatically adhering thereto and forming a real image in toner on the belt.

Next, the belt proceeds around another roller and generally vertically upward through a transfer zone or station. At the transfer zone, and as its name implies, the toner image is transferred from the photoreceptor belt to copy paper provided from one or more trays.

It is with sheets that are en route to the transfer station that the cross roll registration system of the present invention is employed that is shown in FIG. 1. In the printing apparatus A, copy sheets 5 are fed from a paper tray (not shown) from right to left as viewed in FIG. 1 and sometimes are initially skewed in the direction of arrow 10. A basis weight detector 15, for example, as shown in U.S. Pat. No. 5,127,643, is positioned upstream of cross roll deskew apparatus 20 and is adapted to sense the weight of each copy sheet and send a signal to controller 16 of printer A which processes each signal and by the use of a lookup table sends a signal to deskewing and registration apparatus 20 for positioning in accordance with the values in the lookup table that are based on the basis weight of the copy sheets. Deskewing and registration apparatus 20 is positioned by linear stepping motor 21 that is connected through a screw 22 to support member 23 that is mounted on structure 24. Structure 24 has an oblong shaped hole therein through which pin 26 is positioned to move laterally. Pin 26 is mounted in clevis 25 as is one end of screw 27. The other end of screw 27 is mounted in support 28 that is attached to housing 30 of deskew and registration apparatus 20.

Housing 30 of deskew and registration apparatus 20 includes a protrusion 32 that extends into a slot 34 in structure 31 of printing apparatus A for pivotal movement left and right as indicated by arrow 11. A "home" position channel sensor 17 is connected to shaft 36 and controller 16 to ensure that after each copy sheet feeding job is finished shaft 36 is returned to its "home" position regardless to the extent it has been moved along slot 34 by motor 21 during the copy sheet feeding operation. A DC or servo motor 33 is positioned within housing 30 for drivingly rotating deskew cross roll 35 in the direction of arrow 39. The speed of motor 33 is controlled by controller 16 in accordance with a lookup table in controller 16 based on particular basis weights of copy sheets detected by sensor 15. An idler roll 38, shown in phantom, forms a nip with driving deskew cross roll 35 to drive copy sheets 5 against registration edge 19 in order to deskew and register the sheets.

After deskew and registration, copy sheets 5 are driven in the direction of arrow 12 toward the transfer station of printer apparatus A where an image is transferred to each copy sheet. Basis weight sensor 15 in the paper path prior to deskew and registration apparatus 20 provides the explicit copy sheet characteristic data necessary to adjust deskew cross roll 35 into a predetermined angle Θ and provide the rotational speed of cross roll 35 to obtain the required feeding efficiency for the particular weight of copy sheets being fed. Driving deskew cross roll 35 is mounted such that its pivot is at the intersection of the deskew cross roll centerline 40 and the deskew cross roll width centerline 41. The angle of the deskew cross roll is controlled by linear stepper motor 21 and "home" position channel sensor 17 and drive to the deskew cross roll is provided by either a servo motor or micro stepping step motor 33.

In operation, a copy sheet 5 is fed from a copy sheet tray (not shown) and driven into baffle guide unit 14 toward a transfer station (not shown). The copy sheet en route to the transfer station encounters paper weight sensor 15 which measures the basis weight of the copy sheet and sends a signal of the same to conventional controller 16 which processes the signal in accordance with previously stored data. Based on values in a lookup table, computer 16 signals linear stepper motor 21 which upon actuation moves support 28 and protrusion 32 of housing 30 either forward or backward in slot 31. This movement of housing 30 repositions deskew cross roll 35 to a predetermined deskew angle Θ with respect to registration wall 19 and incoming copy sheets 5. In addition to positioning deskew cross roll 35 in this manner, controller 16 also sends a signal by way of 37 to DC stepper motor 33 in order to control the speed of deskew cross roll 35 based on the weight of the copy sheets. After each copy sheet 5 is deskewed and registered against registration edge 19 it is conveyed in direction of arrow 12 for processing purposes. Once a particular copy run has been completed controller 16 repositions shaft 36 in its "home" position for the next copy run of possibly different copy sheet weights.

It should now be apparent that a system for deskewing copy sheets in a machine, such as, a printer or copier has been disclosed that includes a swiveling cross roll assembly. The cross roll assembly employs deskew cross rolls with the driving cross roll angle and speed being made variable based on copy sheet weight through manipulation of the swiveling cross roll assembly and rotation of the driving cross roll.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

What is claimed is:

1. In an electrostatographic printing machine having a photoreceptor belt passing through an inlet end of a transfer zone, and copy sheet transport means for supplying a copy sheet to the inlet end of the transfer zone, the improvement for reducing transfer of images onto skewed copy sheets by ensuring deskew of the copy sheets prior to reaching the transfer zone, characterized by:

a registration edge;

an idler roll;

a driven cross roll that mates with said idler roll for registering copy sheets against said registration edge;

a pivotable support onto which said driven cross roll is mounted for pivotal movement about a predetermined point on said drive cross roll;

a motor connected to said pivotable support for moving said pivotable support in a predetermined direction;

a copy sheet basis weight detector positioned upstream of said driven cross roll and adapted to sense the weight of copy sheets before they reach said driven cross roll; and a controller, said controller being adapted to receive a signal from said basis weight detector and in turn actuate said motor to pivot said pivotable support a predetermined amount.

2. The improvement of claim 1, wherein said motor is a linear stepper motor.

3. The improvement of claim 2, wherein said driven cross roll is driven by a DC stepper motor.

4. The improvement of claim 3, wherein said driven cross roll is servo driven.

5. The improvement of claim 4, wherein the output of said DC stepper motor is controlled by said controller in accordance with a signal from said basis weight detector.

6. A copy sheet deskew device for registering copy sheets en route to a processing station of an image processing apparatus, comprising:

a registration edge;

an idler roll;

a driven cross roll that mates with said idler roll for registering copy sheets against said registration edge;

a pivotable support onto which said driven cross roll is mounted for pivotal movement about a predetermined point on said drive cross roll;

a motor connected to said pivotable support for moving said pivotable support in a predetermined direction;

a copy sheet basis weight detector positioned upstream of said driven cross roll and adapted to sense the weight of copy sheets before they reach said driven cross roll; and a controller, said controller being adapted to receive a signal from said basis weight detector and in turn actuate said motor to pivot said pivotable support a predetermined amount based on the weight of the copy sheets.

7. The copy sheet deskew device of claim 6, wherein said motor is a linear stepper motor.

8. The copy sheet deskew device of claim 7, wherein said driven cross roll is driven by a DC stepper motor.

9. The copy sheet deskew device of claim 8, wherein said driven cross roll is servo driven.

10. The copy sheet deskew device of claim 9, wherein the output of said DC stepper motor is controlled by said controller in accordance with a signal from said basis weight detector.

11. A copy sheet deskew device for registering copy sheets en route to a processing station of an image processing apparatus, comprising:

a registration edge;

an idler roll;

a driven cross roll that mates with said idler roll for registering copy sheets against said registration edge;

a pivotable support onto which said driven cross roll is mounted for pivotal movement about a predetermined point on said drive cross roll;

a first motor drivingly connected to said pivotable support for moving said pivotable support in a predetermined direction;

a second motor drivingly connected to said cross roll;

a copy sheet basis weight detector positioned upstream of said driven cross roll and adapted to sense the weight of copy sheets before they reach said driven cross roll; and a controller, said controller being adapted to receive a signal from said basis weight detector and in turn actuate said first motor to pivot said pivotable support a predetermined amount and actuate said second motor while controlling the speed thereof based on the weight of the copy sheets.

12. The improvement of claim 11, wherein said first motor is a linear stepper motor.

13. The improvement of claim 12, wherein said second motor is a DC stepper motor.

14. The improvement of claim 12, wherein said second motor is a servo motor.

* * * * *